US005680851A

United States Patent [19]

Summers

[11] Patent Number: 5,680,851

[45] Date of Patent: Oct. 28, 1997

[54] BALL NOCK AND ASSOCIATED RELEASE

[76] Inventor: Gregory E. Summers, 105 Overlink Ct., Lynchburg, Va. 24503

[21] Appl. No.: 395,435

[22] Filed: Feb. 28, 1995

[51] Int. Cl.[6] ..... F41B 5/18; F41B 5/14

[52] U.S. Cl. ..... 124/35.2; 124/91

[58] Field of Search ..... 124/23.1, 35.2, 124/90, 91, 92

[56] References Cited

U.S. PATENT DOCUMENTS

| | | | |
|---|---|---|---|
| 2,417,791 | 3/1947 | Tyszkiewicz | 124/35.2 |
| 2,488,597 | 11/1949 | Konold | 124/35.2 |
| 2,637,311 | 5/1953 | Rose | 124/35.2 |
| 2,777,437 | 1/1957 | Allen | 124/91 |
| 2,819,707 | 1/1958 | Kayfes et al. . | |
| 2,905,166 | 9/1959 | Niemeyer | 124/91 |
| 2,965,093 | 12/1960 | Arsenault | 124/35.2 |
| 2,977,952 | 4/1961 | Gabriel et al. | 124/35.2 |
| 3,847,133 | 11/1974 | Awiszus | 124/91 |
| 4,086,904 | 5/1978 | Suski et al. | 124/90 |
| 4,134,369 | 1/1979 | Cook | 124/35.2 |
| 4,151,825 | 5/1979 | Cook | 124/35.2 |
| 4,282,851 | 8/1981 | Lyons | 124/35.2 |
| 4,509,497 | 4/1985 | Garvison | 124/35.2 |
| 4,539,968 | 9/1985 | Garvison | 124/35.2 |
| 4,620,523 | 11/1986 | Peck | 124/35.2 |
| 4,656,994 | 4/1987 | Jenks | 124/35.2 |
| 4,674,469 | 6/1987 | Peck | 124/35.2 |
| 4,691,683 | 9/1987 | Peck | 124/35.2 |
| 4,722,319 | 2/1988 | Brady | 124/35.2 |
| 4,791,908 | 12/1988 | Pellis | 124/35.2 |
| 4,881,516 | 11/1989 | Peck | 124/35.2 |
| 4,909,233 | 3/1990 | Stephenson | 124/91 |
| 4,926,835 | 5/1990 | Peck | 124/35.2 |
| 4,930,485 | 6/1990 | Kopper | 124/91 |
| 4,981,128 | 1/1991 | Garvison | 124/35.2 |
| 5,016,603 | 5/1991 | Tentler | 124/91 |
| 5,020,508 | 6/1991 | Greene, Jr. | 124/35.2 |
| 5,027,786 | 7/1991 | Peck | 124/35.2 |
| 5,070,854 | 12/1991 | Peck | 124/35.2 |
| 5,076,251 | 12/1991 | Peck | 124/35.2 |
| 5,078,116 | 1/1992 | Peck | 124/35.2 |
| 5,103,796 | 4/1992 | Peck | 124/35.2 |
| 5,170,771 | 12/1992 | Peck | 124/35.2 |
| 5,170,772 | 12/1992 | Hamm | 124/35.2 |
| 5,247,921 | 9/1993 | Todd | 124/35.2 |
| 5,263,466 | 11/1993 | Peck | 124/35.2 |
| 5,287,842 | 2/1994 | Saunders | 124/91 |
| 5,318,004 | 6/1994 | Peck | 124/35.2 |
| 5,359,983 | 11/1994 | Peck | 124/35.2 |
| 5,361,747 | 11/1994 | Laabs | 124/91 |
| 5,370,102 | 12/1994 | Peck | 124/35.2 |
| 5,390,657 | 2/1995 | Larson | 124/91 |

*Primary Examiner*—John A. Ricci
*Attorney, Agent, or Firm*—Nixon & Vanderhyde P.C.

[57] ABSTRACT

An arrow release and bow string nock system includes a bow string nock mounted on a bow string adapted to position a tail end of an arrow on the bow string; the bow string nock comprising a substantially spherical ball formed in two pieces and secured about the bow string by one or more fasteners with the bow string passing through a hole formed in the nock. An associated release device includes a pair of spring biased gripping arms pivotally secured within a housing and movable between grip and release positions by a trigger. The gripping arms each have a substantially semispherical socket for engaging the substantially spherical ball nock. The release device may also be designed for use with a pair of ball nocks bracketing the tail end of an arrow.

32 Claims, 11 Drawing Sheets

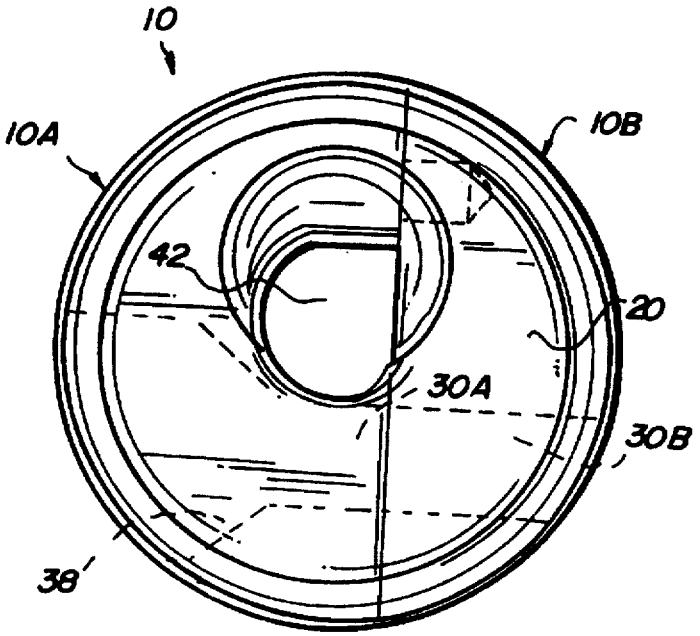
FIG. 5
FIG. 6
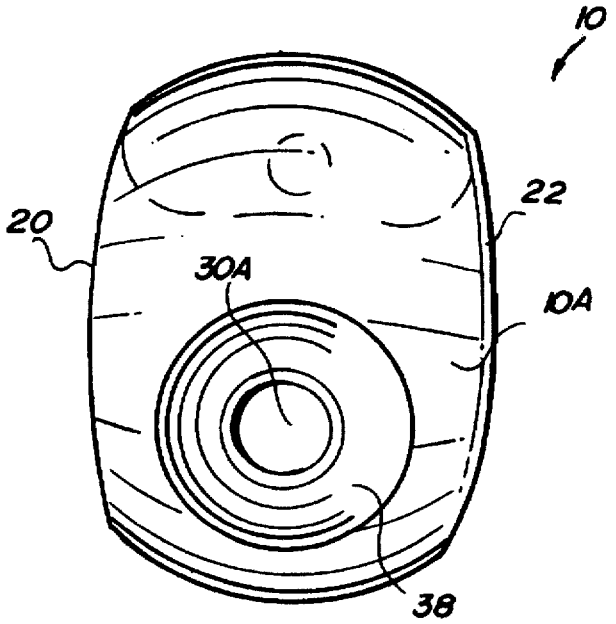

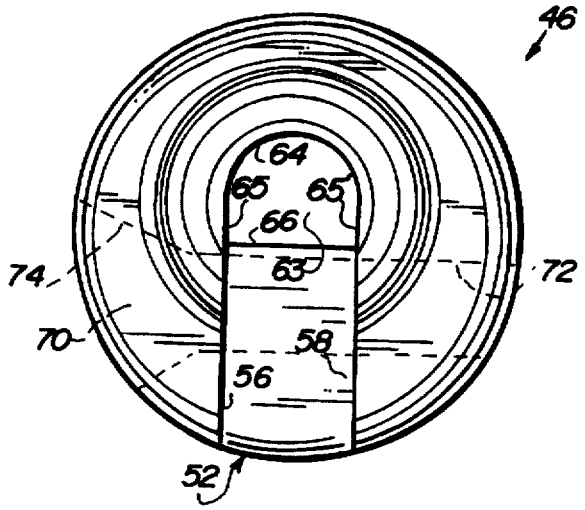
FIG. 7
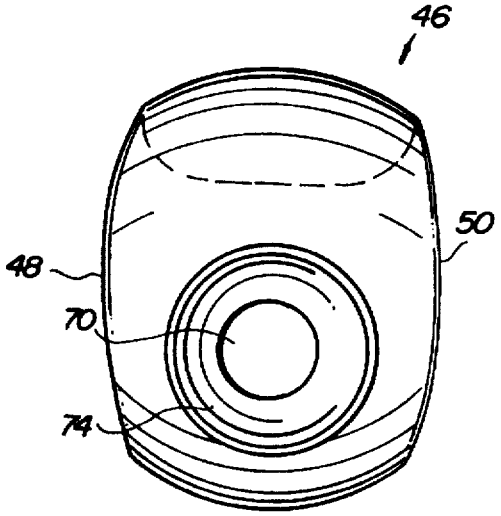
FIG.8
FIG. 9
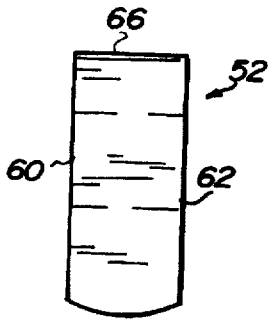
FIG.10
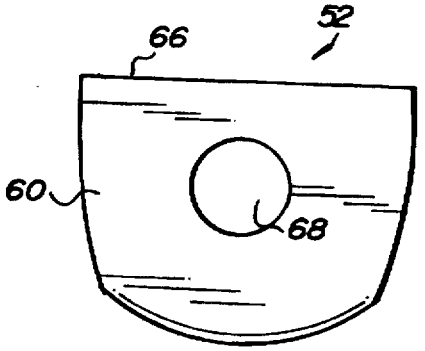

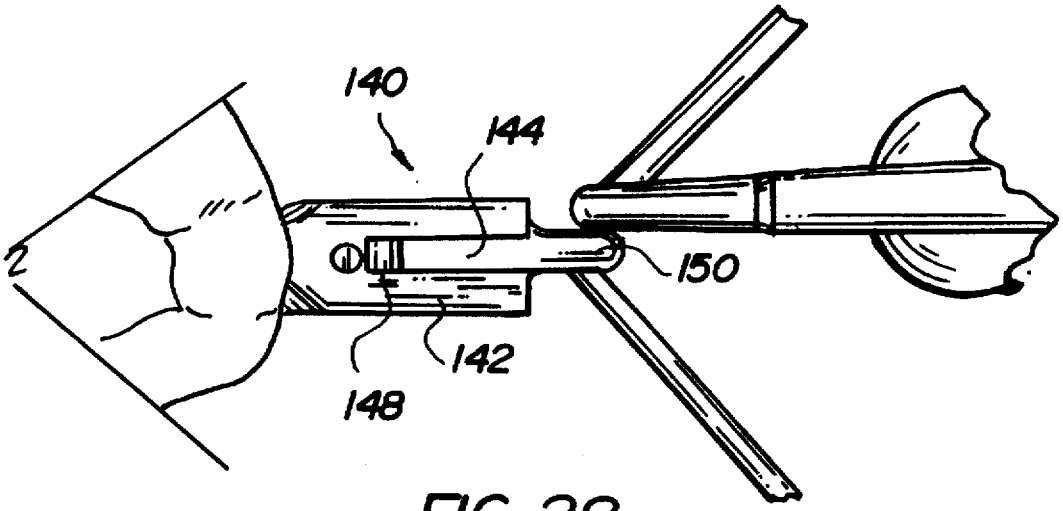
FIG. 28
FIG. 29
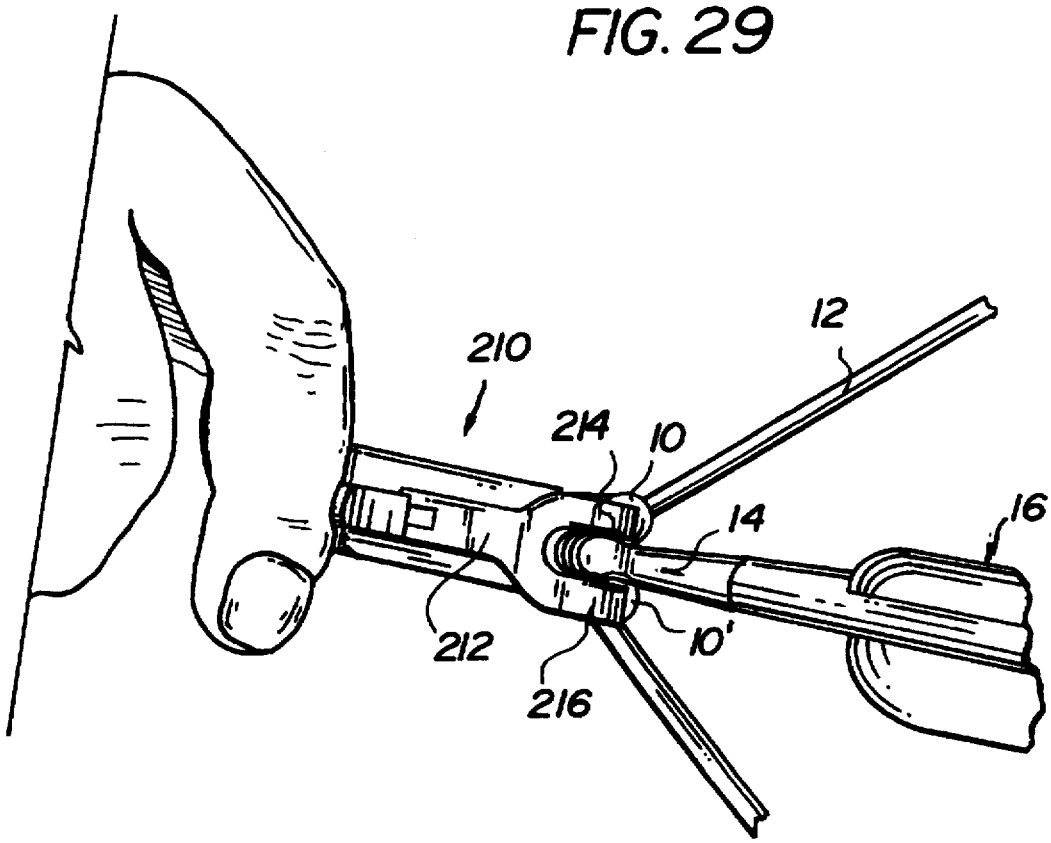

BALL NOCK AND ASSOCIATED RELEASE

BACKGROUND OF THE INVENTION

In the field of archery, it is conventional for an arrow to be provided with a string engaging fork, also known as an arrow nock, at the rear end of the arrow. It is also known to provide a bow string nock which locates the arrow nook on the bow string to facilitate good aim of the arrow. Accordingly, the bow string nock must be located on the bow string substantially at the center of the string and substantially horizontally aligned with the point at which the forward end of the arrow is supported at the center of the bow. Representative bow string nocks are described, for example, in U.S. Pat. Nos. 5,361,747; 4,909,233; and 2,905,166.

It is also known to provide various forms of hand held gripping and firing devices designed to cooperate with a bow string nock that enable an archer to apply a strong pull to the bow string and to release the arrow without having to grip the end of the arrow and the bow string with the fingers. See, for example, U.S. Pat. Nos. 5,016,603 and 4,930,485. U.S. Pat. No. 4,930,485 discloses a half loop shaped center nock having two ends attached to the bow string, in combination with a bow string drawing device which includes a releasable draw pin that engages the half loop portion of the nock. The drawing device also includes a trigger designed to release the bow string upon operation of the trigger. Other release devices are described in U.S. Pat. Nos. 5,247,921; 5,170,772; 5,020,508 and 4,926,835.

SUMMARY OF THE INVENTION

This invention relates to new ball-shaped bow string nocks which serve not only to position the tail end of an arrow (also known as the arrow nock) on the bow string, but also serve to work in cooperation, if so desired, with complementary gripping jaws on a release device.

In one exemplary embodiment, the ball-shaped bow string nock is formed in two pieces, adapted to be secured together along mutually engaged interface surfaces via a pin and fastener arrangement described below. The two piece ball is essentially spherical in shape, but with somewhat flattened surfaces on opposite sides. Each piece is formed with an internal groove extending between the flattened sides, creating a closed but non-round through hole when the two pieces are assembled. A first, larger piece is formed with a screw hole on one side of the internal groove, and a projecting pin on the other side of the groove. The second, smaller piece is formed with a threaded hole on one side of its own internal groove and an alignment pin receiving recess on the other side of its groove. When the two pieces are properly oriented along the generally flat interface surfaces, the screw holes are aligned with each other and the pin and recess are also aligned with each other. It will be appreciated that the fastening screw and the alignment pin extend parallel to each other but perpendicular to the through hole formed by the aligned grooves. In this embodiment, the bow string through hole is not quite concentric with the ball outer circumference because of the placement of the pin and fastener holes. The ball nock is assembled on the bow string, with the bow string extending through the hole formed by the two internal grooves. Once properly oriented, the fastener screw is tightened to firmly clamp the ball nock to the string. The non-round cross-section of the through hole insures good clamping action.

It will be appreciated that the ball nock as described above may be used alone to position a tail end of an arrow along the string, or may be used in tandem with another similar ball nock to "bracket" the tail end of the arrow in the desired location.

In another embodiment, the ball nock is formed as described above but in two substantially identical split halves. In this embodiment, the alignment pin and recess is replaced by another screw fastener, and the bow string through hole is substantially concentric with the ball circumference.

In a third exemplary embodiment, the ball nock is again formed in pieces, with a first larger piece having a substantial C-shape, and the second smaller piece shaped as a segment adapted to fill the gap between the two legs of the C-shaped first piece. A screw fastener is used to secure the segment in place.

In a fourth exemplary embodiment, a double connected ball nock is provided which is similar to the first described embodiment except that the two larger pieces of two ball nocks are connected by a cross support generally aligned with the screw fastener holes. In other words, the cross support extends along and parallel to the aligned internal grooves of the larger ball pieces. The two smaller ball pieces are secured to the larger connected ball pieces by a pair of screw fasteners and a pair of alignment pin/recess elements, also as described hereinabove with respect to the first described embodiments.

All nock parts (with the exception of the screws) are machined from aircraft Aluminum, reducing weight while increasing durability. The nocks are also designed to eliminate string wear and cable interference; they are easy to install and adjust for bow tuning.

In the single nock configuration, the arrow locates on the top of the ball nock, eliminating arrow "porpoising" throughout arrow acceleration following release.

In the double nock arrangement, the arrow is prevented from falling off the string at full draw. Arrow "porpoising" during arrow acceleration is eliminated as with the single nock. In addition, the double nock arrangement maintains a 90° angle between the arrow and bow string at all times.

In the double connected nock arrangement, additional advantages are gained in that the cross support strengthens the bow string behind the arrow during arrow propulsion, and maintains peep sight alignment as the arrow is nocked. The cross bar connects the ball nock sections as a single unit, maintaining separation while angular forces from the bow string are exerted at full draw.

Another aspect of the invention relates to a new release device which is particularly suited for use with the ball-shape nocks described above. A single release in accordance with the invention has caliper style jaws. The release jaws include semi-spherical sockets so as to conform to the ball nock. As a result, radial swivel action is permitted between the release and the bow string, thereby eliminating the bi-directional forces exerted upon the bow string by the archer during all positions of the pull, from beginning to full draw. The single release contacts only the ball nock, thereby also eliminating string wear.

In the exemplary embodiment, the single ball release includes a housing which pivotally mounts the pair of opposed jaws, and which also pivotally mounts an associated trigger mechanism. The latter is operatively connected to the jaws by ball and spring elements such that movement of the trigger causes movement of a ball actuator against the forces exerted by a coil spring. Movement of the ball allows the inner ends of the jaws to pivot inwardly under the influence of the spring, thus causing the outer ends of the jaws to pivot outwardly to thereby release the arrow via the bow string ball nock.

In another embodiment, each jaw element is formed with a pair of ball nock sockets in a U-shaped yoke for use with a double bow string nock as described above.

The above described release devices and specifically the substantially spherical ball/socket design:

1. Eliminates bi-directional forces exerted by the archer during and after the draw.
2. Increases accuracy of the arrow flight.
3. Eases the effort of the archer during the draw.
4. Lessens "Trigger Jerk" inaccuracy.
5. Insures absolute accuracy of position for arrow, when used with double connected nock on bow string.

Other advantages include an ultra quiet firing mechanism which always returns to a closed position; an adjustable trigger to enable "Hair Trigger" sensitivity; and elimination of bow string wear.

In addition, the double nock release may be attached to a double connected ball nock in the ready to fire mode with arrow attached, allowing the hands to remain free. The release also maintains a flat 90 degree bow string behind the arrow at all times. It should also be noted that the arrow remains nocked even after returned to relaxed position after full draw should decision be made not to fire. Finally, the release devices of this invention may be used to hoist the bow to tree stands, etc.

In one aspect, the invention broadly comprises an arrow release and bow string nock system comprising a bow string nock mounted on a bow string adapted to position a tail end of an arrow on the bow string; the bow string nock comprising a substantially spherical ball formed in two pieces and secured about the bow string by one or more fasteners with the bow string passing through a hole formed in the nock; and a release device comprising a pair of spring biased gripping arms pivotally secured within a housing and movable between grip and release positions by a trigger; the gripping arms each having a substantially semi-spherical socket for engaging the substantially spherical ball nock.

In another aspect, the invention comprises a bow string nock comprising two parts which, when assembled, form a substantially ball shaped nock body, each part formed with an internal groove shaped to form a nonround through hole when the parts are assembled, and at least one fastener screw for securing the two parts together.

In still another aspect, the invention comprises a bow string nock comprising a pair of substantially spherical nock portions connected by a cross support bar, the nock portions formed, respectively, with aligned through holes for receiving a bow string.

Other objects and advantages of the present invention will become apparent from the detailed description which follows.

BRIEF DESCRIPTION OF THE DRAWINGS

FIG. 5 is a plan view of the single ball nock shown in FIG. 3;

FIG. 6 is a side elevation of the ball nock illustrated in FIG. 5;

FIG. 7 is a plan view of a single ball nock in accordance with a second exemplary embodiment of the invention;

FIG. 8 is a side elevation of the ball nock illustrated in FIG. 7;

FIG. 9 is a plan view of a ball nock segment removed from the ball nock shown in FIG. 7;

FIG. 10 is a side view of the segment shown in FIG. 9;

FIG. 28 is a side elevation showing the single ball nock release in engagement with a single ball nock mounted on a bow string; and FIG. 29 is a partial perspective of a double ball nock release in accordance with the invention.

DETAILED DESCRIPTION OF THE DRAWINGS

Figure 1:
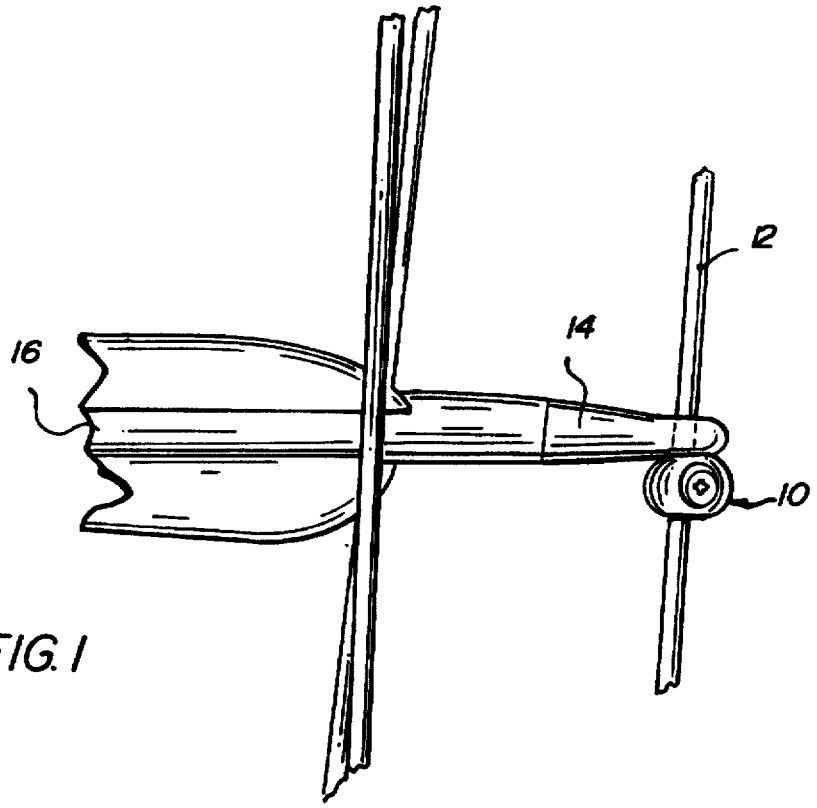
FIG. 1 is a partial side elevation illustrating a single ball nock in accordance with this invention located on a bow string and supporting the tail end of an arrow.

With reference to FIG. 1, the bow string ball nock 10 of this invention is illustrated, and the manner in which the nock supports the tail end 14 of the arrow when used alone.

Figure 2:
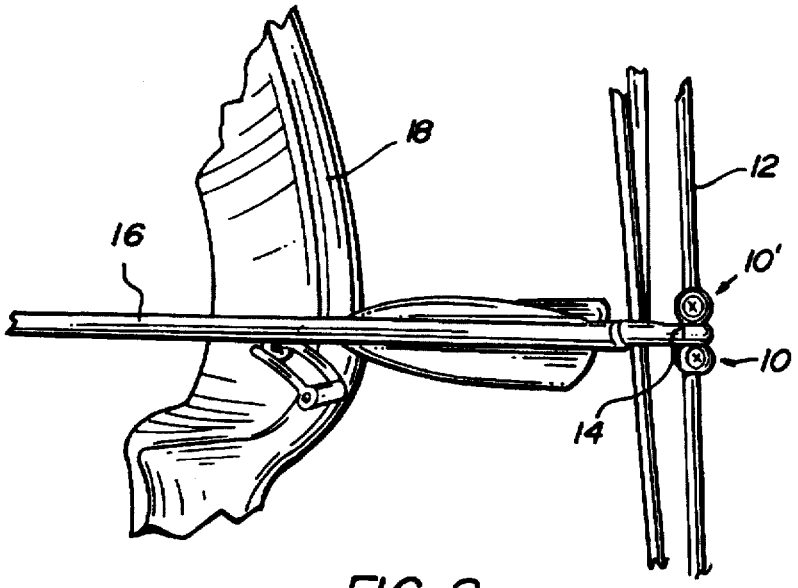
FIG. 2 is a partial side elevation similar to FIG. 1 but illustrating a pair of bow string ball nocks in accordance with the invention, mounted on a bow string and bracketing the tail end of an arrow.

FIG. 2 shows the nock utilized in tandem with a second similar ball nock 10', shown mounted on a bow string 12. The tail end 14 of an arrow 16 is shown in a shooting orientation vis-a-vis the bow 18 and nock pair 10, 10', prior to draw. The nocks 10 and 10' "bracket" the tail end 14 of the arrow 16, providing good support during draw and release.

Turning to FIGS. 3–6, the ball nock 10 is shown in detail in both split and assembled form. In its assembled state, the ball nock 10 is substantially spherical in shape, but with two opposite, slightly flattened sides 20, 22. As can be seen best in FIGS. 3 and 5, the pieces 10A and 10B are dissimilar in size, piece 10A being the larger of the two.

Figure 3:
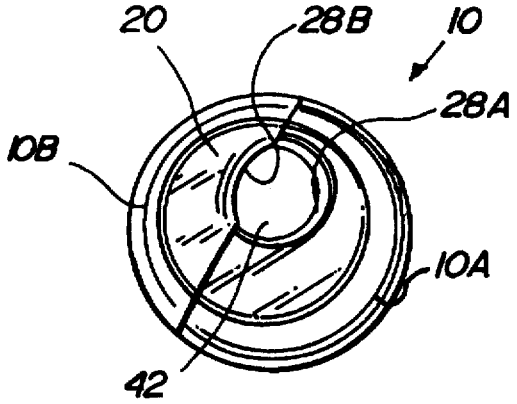
FIG. 3 is a perspective view of a single ball nock in accordance with the invention.
Figure 4:
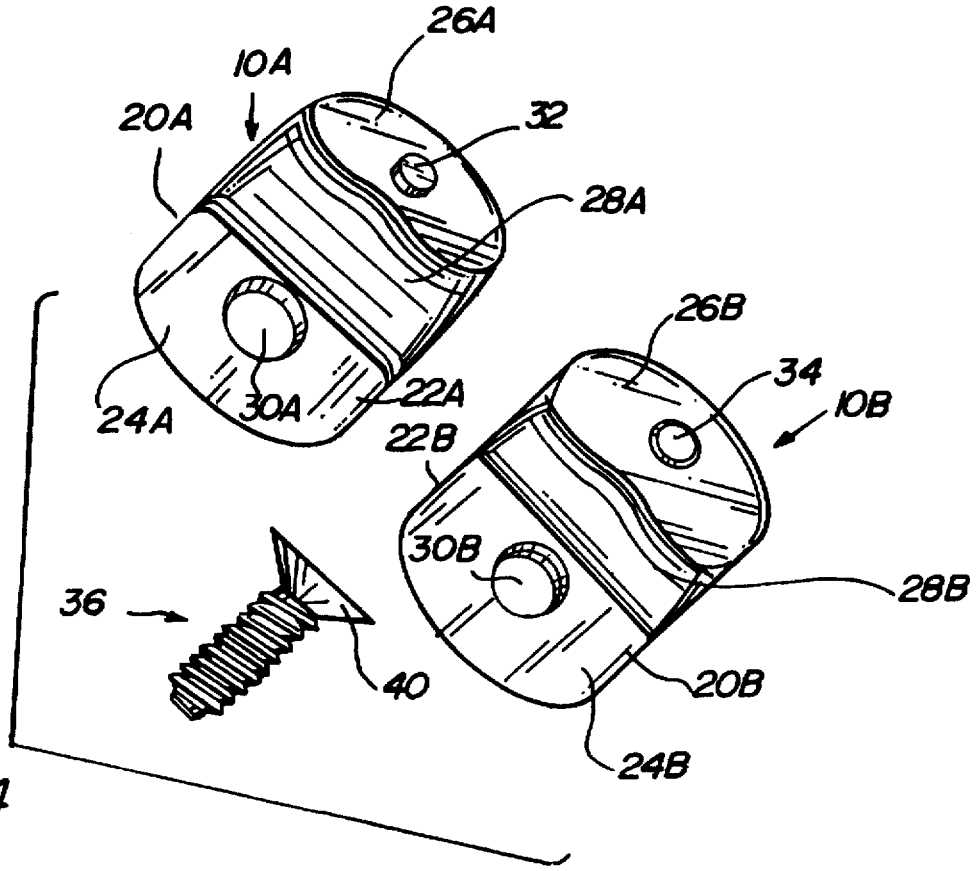
FIG. 4 is a perspective view of separated ball nock pieces which, with assembled, form the ball nock shown in FIG. 3.

With specific reference to FIG. 4, the two nock pieces 10A, 10B are engaged along substantially flat, paired interface surfaces 24A and 26A on piece 10A, and surfaces 24B and 26B on piece 10B. The surfaces 24A and 26A are substantially, but need not be, co-planar. They must in any event be paired with corresponding surfaces 24B and 26B so that the respective surfaces are in flush engagement when assembled as shown in FIGS. 3 and 5. The surfaces 24A and 26A are bifurcated by a groove 28A extending between sides 20A and 22A. A similar groove 28B is formed in piece 10B between the surfaces 24B and 26B and extending between sides 20B, 22B.

A fastener hole 30A is formed in the piece 10A, opening into surface 24A. A corresponding threaded hole 30B is formed in piece 10B, opening into the surface 24B. An alignment pin 32 projects form surface 26A and is adapted for reception in pin socket 34 formed in surface 26B. With this arrangement, the pieces 10A, 10B can clamped in about the bow string 12 and clamped in place via screw 36 inserted into hole 30A and threaded within the axially aligned hole 30B. Holes 30A and 30B are aligned with the aid of pin 32 which is received in the hole or recess 34. Hole 30A is formed with a bevelled entry surface 38 on the exterior of piece 10A which receives the similarly shaped screw head 40 so that the latter does not project from the ball (see FIGS. 5, 6 and 8).

Notice also that the grooves 28A and 28B which extend transversely of the fastener holes 30A, 30B and pin 32/recess 34, are formed symmetrically to form a non-round through hole 42 when the pieces 10A and 10B are assembled. This insures good clamping action between the ball nock 10 and the bow string 12. Reference is again made to FIGS. 1 and 2 to illustrate the manner in which a single nock 10, or a pair of nocks 10, 10' may be used to position an arrow 16 on the string 12.

Turning now to FIGS. 7–10, another ball nock 46 in accordance with this invention is illustrated which is also of two-piece form. In this configuration, the overall shape of the nock is substantially the same as the nock 10, i.e., substantially spherical but with slightly flattened opposite sides 48, 50. In this case, however, the two piece nock is configured to include a slice or segment 52 from a substantially C-shaped (when the body portion 54 is rotated 90° in a counterclockwise direction as viewed in FIG. 7) body portion 54. In this instance, the segment extends only about 20° of the total circumference of the nock as viewed in FIG. 7. Body portion 54 includes flat, opposed interface surfaces 56, 58 which engage complementary mating surfaces 60, 62 of the segment 52. The latter is sized so that, when in place, there remains a non-round through hole 63 defined by curved surface 64 in the main body portion 54, flat extensions 65, 65' of the curved surface 64, and flat surface 66 of the segment 52.

The segment 52 is also provided with a transverse through hole 68 which is located to align with similarly aligned fastener holes 70, 72 formed in the body portion 54. Hole 70 is bevelled at 74 to accommodate a fastener screw head in a manner similar to hole 30A in the previously described embodiment. A screw, such as shown at 36 in FIG. 4 may be used to secure the segment in place via hole 70, hole 66 and threaded hole 72.

It will be appreciated that the nock 46 is useable with bow string 12 alone or in tandem in the same manner as the nock 10.

Figure 11:
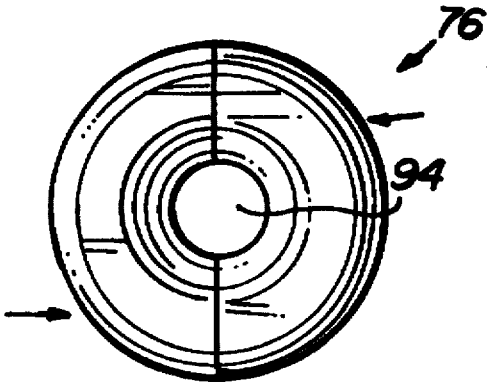
FIG. 11 is a plan view of a single ball nock in accordance with a third exemplary embodiment of the invention.
Figure 12:
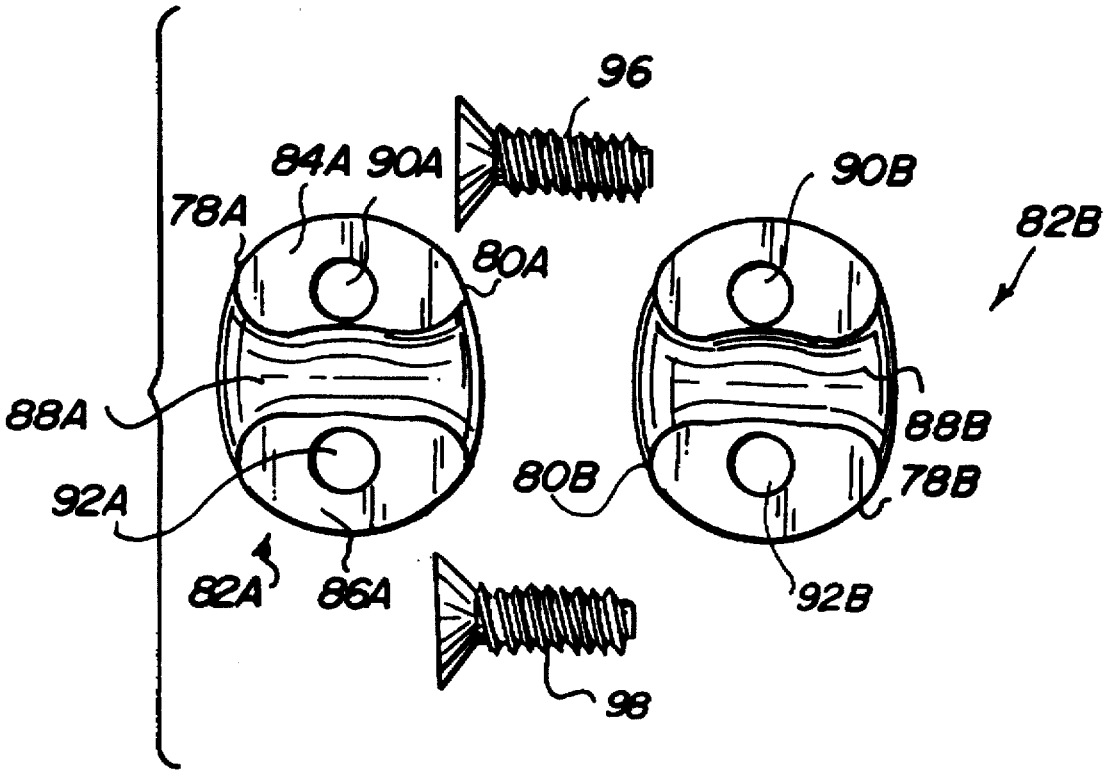
FIG. 12 illustrates separated ball nock pieces which, when assembled, form the ball nock shown in FIG. 11.

Turning now to FIGS. 11 and 12, a ball nock 76 in accordance with a third embodiment of the invention is illustrated which is formed to have a substantially overall spherical shape with slightly flattened sides (78A, B and 80A, B) as in the previously described embodiments. Here, however, the nock is formed to include two, substantially identical split halves 82A and 82B. Since the split halves are identical, only one will be described in detail, noting that similar reference numerals are used in connection with split half 82B, with the suffix "B" added to each numeral. Split half 82A is formed with flat interface surfaces 84A and 86A which lie on opposite sides of a transverse groove 88A. Fastener holes 90A and 92A extend through the split half 82A in a direction perpendicular to the half groove 88A, and open into the flat interface surfaces 84A and 86A, respectively. When assembled, a bow string through hole 94 is formed by the split grooves 88A and 88B as best seen in FIG. 11. The hole 94 is substantially round but the irregular groove contours in the respective split halves 2A and 82B and the selection of an average diameter slightly less than the diameter of the bow string insures good clamping action. In this embodiment, a pair of screw fasteners 96, 98 are used to secure the split halves 82A and 82B together, preferably with the screws entering from opposite directions on opposite sides of the nock, as indicated by the arrows in FIG. 11. Here again, the nock 76 may be used singly or in tandem, with or without an associated release, as described further herein.

Figure 13:
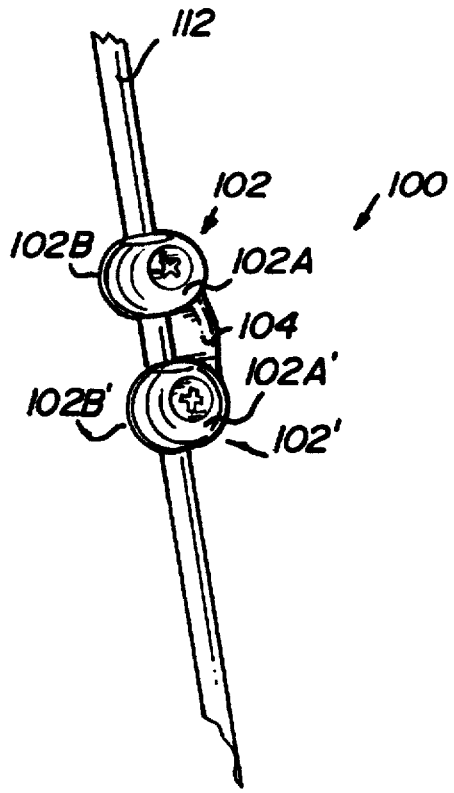
FIG. 13 is a perspective view of a double connected ball nock in accordance with the invention, shown in perspective and mounted on a bow string.
Figure 14:
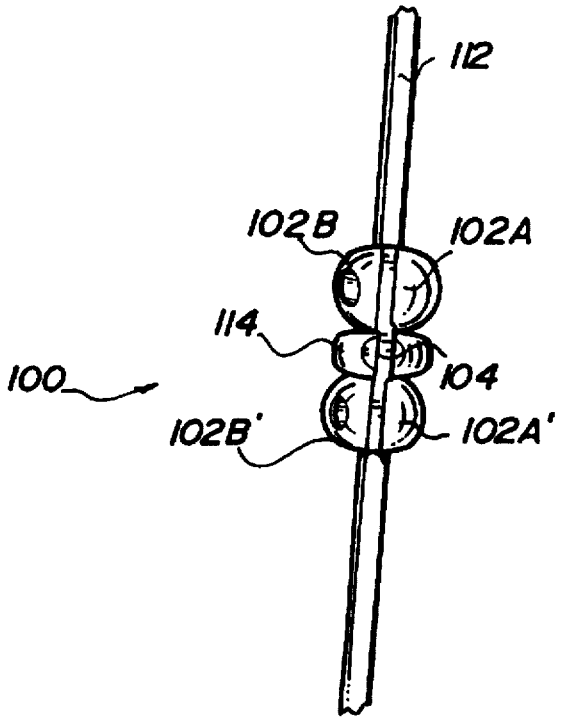
FIG. 14 is a rear elevation of the double connected ball nock shown in FIG. 13, and also illustrating the manner in which the tail end of an arrow interacts with the double connected ball nock.
Figure 15:
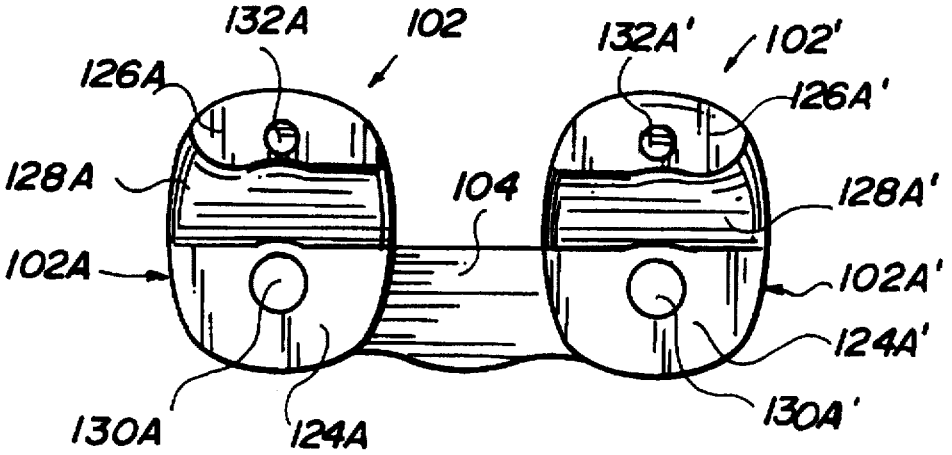
FIG. 15 is a side elevation of one portion of the double connected ball nock illustrated in FIG. 13.
Figure 16:
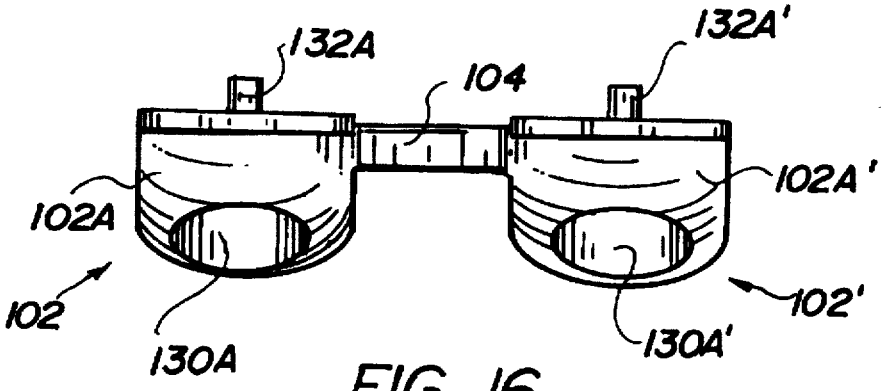
FIG. 16 is a plan view of the ball nock portion illustrated in FIG 15.
Figure 17:
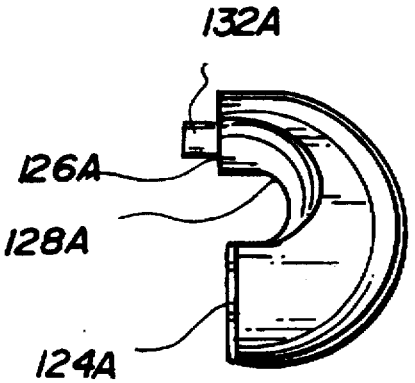
FIG. 17 is a side elevation of the ball nock portion illustrated in FIG. 16.

With reference now to FIGS. 13–17, a double-connected ball nock 100 in accordance with the invention includes, in effect, two ball nocks similar to those shown at 10 and 10' in FIG. 2, but with a cross support bar connecting the nocks. Thus, in FIG. 13, the double-connected ball nock 100 includes a first nock portion 102 and a second nock portion 102' connected by cross support bar 104. The construction of the nock pieces 102A, B and 102A', B' is also similar to the nock 10 in that nock pieces 102A and 102A' are larger than nock pieces 102B and 102B'. It is the larger pieces 102A and 102A' which are connected by the integral cross support bar 104 as best seen in FIGS. 15–17. The smaller nock pieces 102B and 102B' (which are substantially identical to the nock piece 10B) are secured via a fastener screw and alignment pin arrangement similar to that described in connection with the nock 10, and need not be repeated here. For convenience, reference numerals similar to those used in FIG. 4 have been applied to FIGS. 15–17, but with the prefix "1" added in order to indicate corresponding surfaces and/or elements. The manner in which the nock 100 is assembled and positioned on the bow string 112 is shown in FIGS. 13 and 14, and note in FIG. 14 the manner in which the tail end of an arrow (or arrow nock) 114 fits between the nock portions 102 and 102' and straddles (and is thus supported by) the cross support bar 104.

The bow string nocks 10, 46, 76 and 100 as described above are preferably formed of aircraft Aluminum, machined to the desired size and shape, thus reducing weight and increasing durability. Note also that, in each case, the bow string grooves in the split nock pieces are bevelled or chamfered at the respective entries/exits of the nock pieces to accommodate directional flexing of the bow string during draw and release. The specific configuration of the split grooves and other surfaces are not to be limited, however, to the specific examples described herein. Design details may be varied as desired and remain within the scope of the invention.

Figure 18:
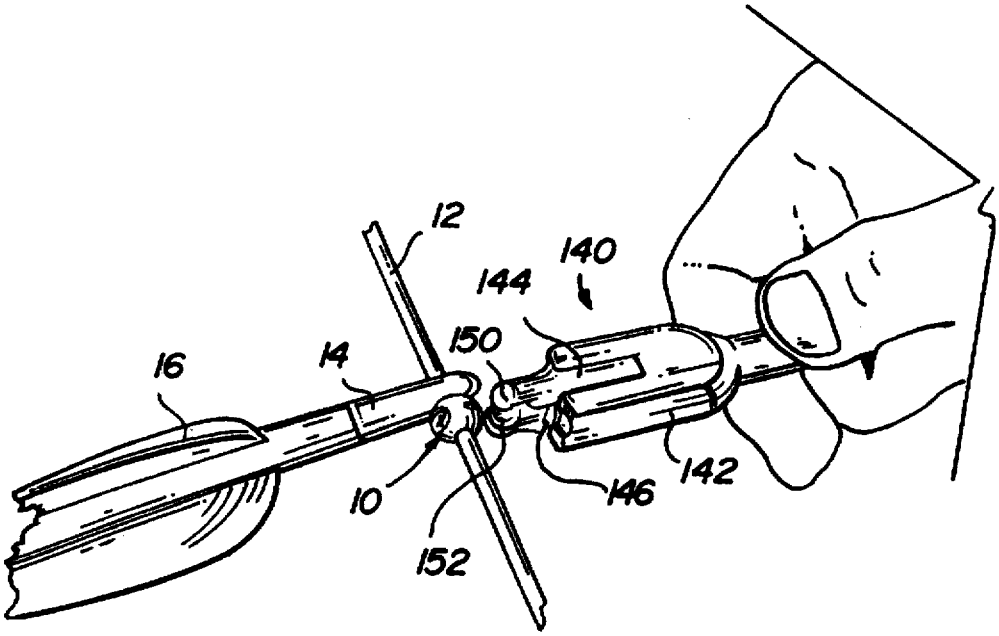
FIG. 18 is a partial perspective view illustrating a single nock release in accordance with the invention, shown in close association with a single ball nock of the type illustrated in FIG. 1.

Referring now to FIG. 18, a single caliper release 140 in accordance with this invention is shown in position to engage the single ball nock 10 as shown in FIG. 1. This release, of course, can also be used with nocks 47 and 76. The release 140 includes a housing portion 142, a pair of arms 144, 146 pivotally mounted within the housing 142, and a trigger 148 (not visible in FIG. 18 but shown in FIGS. 23–28). The arms 144, 146 terminate at gripping jaws which include substantially semi-spherical sockets 150, 152 which are generally complementary to the exterior surface of the ball nock 10.

Figure 19:
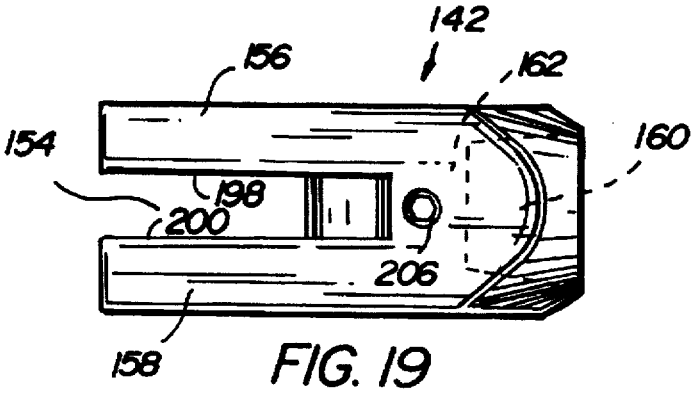
FIG. 19 is a bottom plan of the single nock release housing incorporated in the release shown in FIG. 18.
Figure 20:
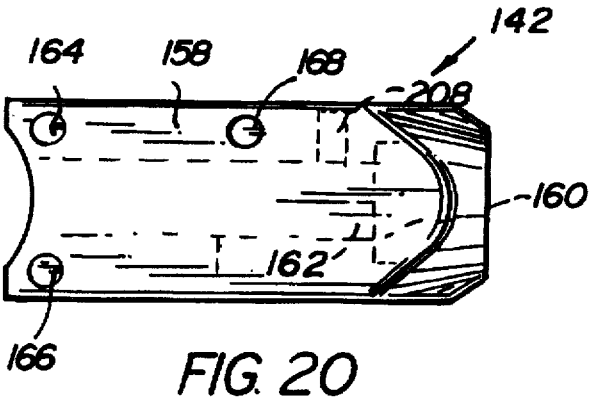
FIG. 20 is a side elevation of the housing illustrated in FIG. 19.

FIGS. 19 and 20 illustrate the housing 142 which includes a solid body, formed to include an open ended slot 154 at one end to create a pair of spaced sides 156, 158 and bored at an opposite end to include a threaded attachment hole 160 and a smooth extension 162 which opens into the slot 154. The gripping arms 144, 146 are pivotally secured within the slot 154 of the housing 142 by means of pins extending through holes 164, 166 as described in greater detail below. A third pin hole is used to 168 pivotally mounts the trigger 148 as also described below. The threaded hole 160 is utilized to secure the release to an otherwise conventional wrist strap (not shown).

Figure 21:
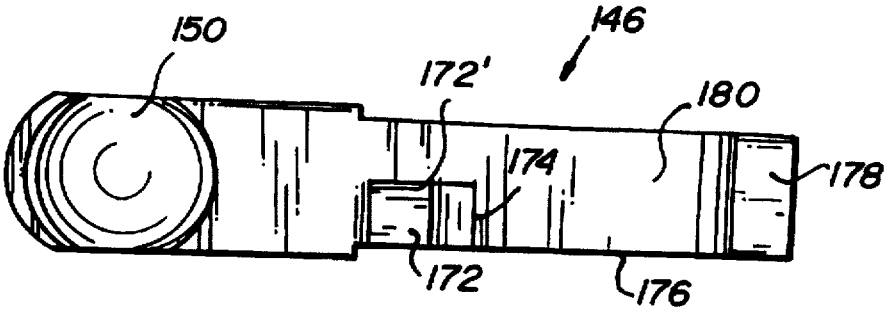
FIG. 21 is a top plan of a gripping jaw arm incorporated in the single nock release shown in FIG. 18.
Figure 22:
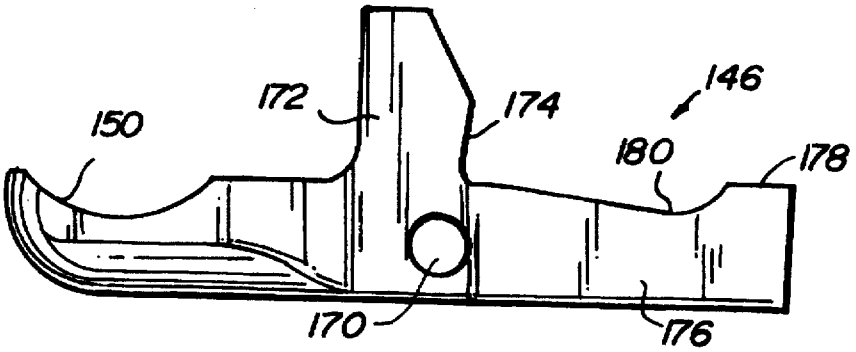
FIG. 22 is a front elevation of the gripping jaw arm illustrated in FIG. 21.
Figure 27:
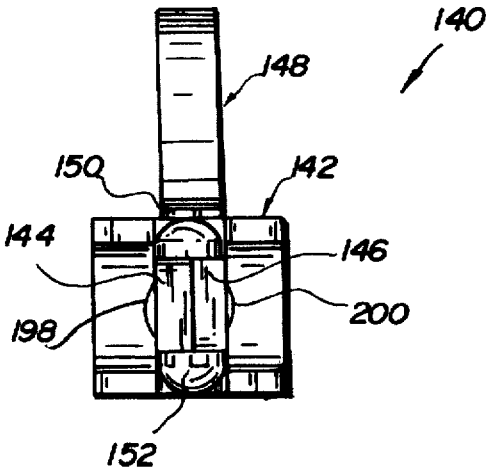
FIG. 27 is a front elevation of the single ball nock release shown in FIG. 18.

The arm 146 is shown in detail in FIGS. 21 and 22, it being understood that the second arm 144 is a mirror image thereof which need not be described in detail. The arm 146, in addition to the nock receiving socket 150, includes a pivot pin bore 170 by which the arm is pivotally mounted in the housing 142. A spring engaging extension 172 projects transversely of the arm proper, and, as shown in FIG. 21, the extension 172 is axially offset from the center axis of the arm. This arrangement allows the arms 144, 146 to lie in flush engagement along surface 172' so that the arms are co-planar, with sockets 150, 152 in vertical and horizontal alignment, as best seen in FIG. 27. The extension 172 is formed with a spring engagement surface 174, the purpose for which will be described below. The arm 146 also includes a rearward extension 176 which includes a flat 178 and a curved ramp surface 180.

Figure 23:
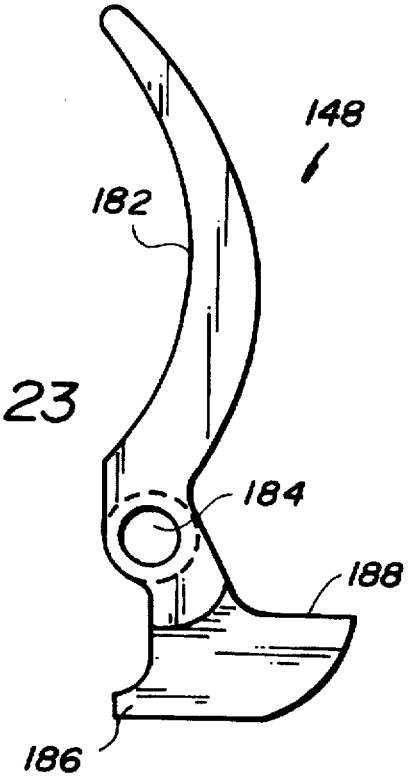
FIG. 23 is a side elevation of a trigger mechanism utilized in the single nock release shown in FIG. 18.
Figure 24:
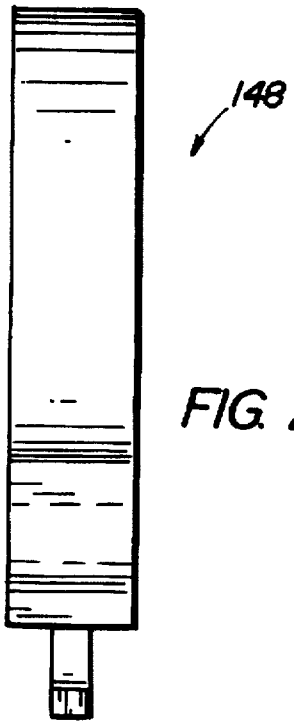
FIG. 24 is a front elevation of the trigger mechanism shown in FIG. 23.

FIGS. 23 and 24 illustrate the trigger device 148 in detail. This trigger element includes a curved, finger engaging portion 182, a pivot mounting hole 184 and a ball actuator projection 186 lying forward of the mounting hole 184. The trigger also includes a stop surface 188 lying rearward of the pivot mounting hole 184 which may be used in conjunction with a set screw in the release housing 142 for adjusting the sensitivity of the trigger as described further below.

Figure 25:
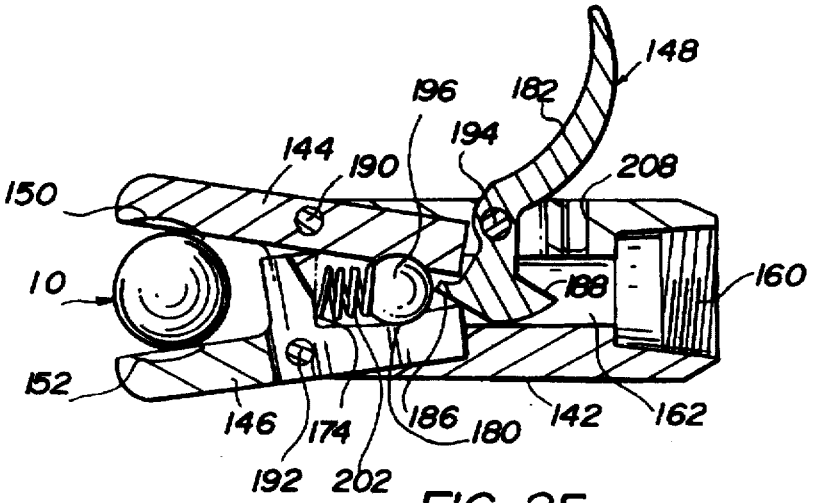
FIG.25 is a side section through the single nock release illustrated in FIG. 1, and shown with the gripping jaw arms in an open position.
Figure 26:
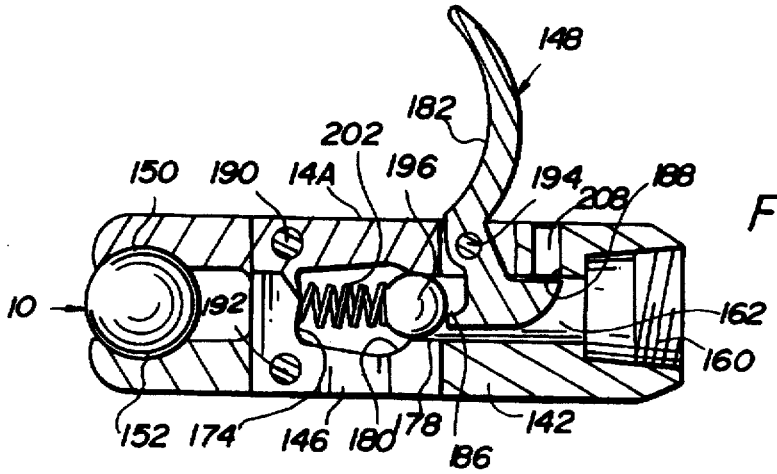
FIG. 26 is a side section similar to FIG. 25 but showing the gripping jaw arms in a closed position about a single ball nock.

With reference now to FIGS. 25 and 26, it will be seen that the arms 144, 146 are pivotally mounted within the housing 142 by means of pins 190, 192 while the trigger device 148 is pivotally mounted in the housing by means of pin 194. A solid ball actuator 196 is mounted within the housing 142 for movement along curved surfaces or groove 198, 200 which extend axially forward of the bore 162, along the groove 154 (see FIGS. 19 and 27).

With reference especially to FIG. 25, it may be seen that by pulling the trigger 148 rearwardly (or clockwise as shown in FIG. 25) about the pin 194, the ball actuator projection 186 will force the ball 196 forwardly along groove surfaces 198, 200 in the housing 142 and against the action of spring 202, so that the ball 196 will move off the flats 178 and ride along ramp surfaces 180, thus allowing the arms 144, 146 to pivot to an open position under the influence of spring 202 acting on spring engaging surfaces 174. In this position, the release 140 may be placed over the ball nock 10, with the nock engaged by the complementary spherical surfaces in sockets 150, 152. Releasing the trigger will bring the arms 144, 146 back to the closed position illustrated in FIG. 26.

Upon a full draw, the arrow 16 may be released by pulling the trigger rearwardly in the same manner as described above.

Another feature of the invention is the incorporation of a set screw 206 (see FIG. 19) which is threaded into the housing 142 in a transverse direction via hole 208, which is located so that the set screw 206 can bear on the trigger stop surface 188, thereby enabling the user to create a "hair trigger" sensitivity for firing pressure or trigger movement. In other words, the set screw 206 can be used to eliminate all lost motion of the trigger so that the ball actuator projection 186 is always in contact with the ball 196.

FIG. 29 illustrates a modified version of the release for use with a double ball nock arrangement as shown in FIGS. 2, 13 or 14. In this embodiment, the release 210 includes pivotally mounted arms (one shown at 212) which are bifurcated to each include spaced apart gripping jaws 214, 216 and corresponding semi-spherical sockets enabling gripping engagement with a pair of ball nocks 10, 10' or with a double connected ball nock as described above. Otherwise, the construction and manner of operation of the double nock release 210 is the same as the single nock release 140.

In both single and double release form, the above described release devices 140 and 210 eliminate bi-directional forces between the archer and bow string during all positions of the draw process. This is due to the unique radial swivel action created by the spherical nock(s) and complementary-shaped release sockets 150, 152. Reference is made back to the Summary of the Invention above for the advantages and benefits associated with the bow string nock and release system of this invention.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An arrow release and bow string nock system comprising:

at least one bow string nock mounted on a bow string and positioned to support a tail end of an arrow on the bow string above said at least one bow string nock; the bow string nock comprising a substantially spherical ball formed in two pieces and secured about the bow string by one or more fasteners with said bow string passing through a hole formed in said nock; and a release device comprising a pair of spring biased gripping arms pivotally secured within a housing and movable between grip and release positions by a trigger; said gripping arms each having a substantially semi-spherical socket for engaging said substantially spherical ball.

2. The system of claim 1 wherein said two pieces of said substantially spherical ball are substantially symmetrical and include screw fasteners.

3. The system of claim 1 wherein said at least one bow string nock includes a second bow string nock comprising another substantially spherical ball also formed in two pieces and also secured to said bow string, spaced below said at least one bow string nock such that the tail end of the arrow can be located between said at least one bow string nock and said second bow string nock.

4. The system of claim 1 and including means for adjusting trigger sensitivity.

5. An arrow release and bow string nock system comprising:

a bow string nock mounted on a bow string adapted to position a tail end of an arrow on the bow string; the bow string nock comprising a substantially spherical ball formed in two pieces and secured about the bow string by one or more fasteners with said bow string passing through a hole formed in said nock; and a release device comprising a pair of spring biased gripping rms pivotally secured within a housing and movable between grip and release positions by a trigger; said gripping arms each having a substantially semi-spherical socket for engaging said substantially spherical ball; wherein said two pieces of said substantially spherical ball are asymmetrical, and include pin and recess alignment means for positioning one of said two pieces relative to the other of said two pieces, and a fastener for securing said two pieces together.

6. An arrow release and bow string nock system comprising;

a pair of bow string nocks mounted on a bow string adapted to position a tail end of an arrow on the bow string between said pair of bow string nocks; each bow string nock comprising a substantially spherical ball formed in two pieces and secured about the bow string by one or more fasteners with said bow string passing through a hole formed in said nock;

a release device comprising a pair of spring biased gripping arms pivotally secured within a housing and movable between grip and release positions by a trigger; said gripping arms each formed with a pair of substantially semi-spherical sockets.

7. The system of claim 6, wherein said substantially spherical ball and said another substantially spherical ball are connected by a cross support bar.

8. An arrow release and bow string nock system comprising:

a bow string nock mounted on a bow string adapted to position a tail end of an arrow on the bow string; the bow string nock comprising a substantially spherical ball formed in two pieces and secured about the bow string by one or more fasteners with said bow string passing through a hole formed in said nock; and a release device comprising a pair of spring biased gripping rms pivotally secured within a housing and movable between grip and release positions by a trigger; said gripping arms each having a substantially semi-spherical socket for engaging said substantially spherical ball; wherein said bow string nock is formed of aluminum.

9. An arrow release and bow string nock system comprising;

at least one bow string nock mounted on a bow string adapted to position a tail end of an arrow on the bow string above said at least one bow string nock; the bow string nock comprising a substantially spherical bow formed in two pieces and secured about the bow string by one or more fasteners with said bow string passing through a hole formed in said nock; and a release device comprising a pair of spring biased gripping arms pivotally secured within a housing and movable between grip and release positions by trigger, said gripping arms each having a substantially semi-spherical socket for engaging said substantially spherical ball; and a coil spring and an actuator ball in axial alignment, interposed between spring engaging surfaces of said gripping arms and said trigger.

10. The system of claim 9 wherein said gripping arms include flats which are engaged by said actuator ball in one position of said gripping arms.

11. The system of claim 10 wherein said gripping arms include curved ramping surfaces which are engaged by said actuator ball in another position of said gripping arms.

12. The system of claim 11 wherein said bow string nock includes a second bow string nock comprising another substantially spherical ball also formed in two pieces and also secured to said bow string.

13. A bow string nock comprising two parts which, when assembled, form a substantially ball shaped nock body, each part formed with an internal groove shaped to form a non-round through hole when said parts are assembled, and at least one fastener screw for securing said two parts together.

14. The bow string nock of claim 13 and further including pin and recess alignment means for facilitating assembly of said two parts.

15. The bow string nock of claim 13 wherein two fastener screws are used to secure said two parts in assembled relationship.

16. A bow string nock comprising a pair of substantially spherical nock portions connected by a cross support bar, the nock portions formed, respectively, with aligned non-round through holes for receiving a bow string.

17. The bow string nock of claim 16 wherein each nock portion is formed in two pieces, each piece formed with an internal groove which, when said two pieces are assembled, form a respective one of said non-round through holes.

18. The bow string nock of claim 17 and including means for fastening said two pieces in assembled relationship.

19. The bow string nock of claim 18 wherein said means includes at least one screw fastener.

20. The bow string nock of claim 16 wherein said cross support bar is aligned on center with said nock portions and said through holes.

21. A bow string release device comprising a housing having an open ended slot and a pair of opposed, axially extending grooves;

a pair of gripping arms pivotally secured within said open ended slot of said housing for movements toward and away from each other, said gripping arms each including forward and rearward ends; and a firing mechanism for moving said gripping arms between a closed draw position and an open release position, said firing mechanism including a trigger and a ball actuator proximate said rearward ends, said ball actuator located between and engaged by said gripping arms and mounted in said pair of grooves for axial movement toward and away from said forward ends; and an axially arranged spring having a first end engaging said gripping arms and a second end engaging said ball actuator, wherein said ball actuator is normally biased by said spring to a location between said rearward ends to hold said gripping arms in the closed position and wherein said trigger is adapted to engage said ball actuator and to push said ball actuator toward said forward ends, thereby permitting said gripping arms to move to said open release position.

22. The bow string release device of claim 21 wherein said spring normally resiliently urges said ball to a location between said rearward ends to maintain said gripping arms in said closed position.

23. The bow string release device of claim 22 wherein said trigger is pivotally mounted in said housing.

24. The bow string release of claim 22 wherein said spring is interposed between said ball actuator and a pair of spring engaging projections located intermediate said forward and rearward ends of said gripping arms.

25. The bow string release of claim 24 wherein said gripping arms have ball engaging surfaces located between said spring engaging projections and said rearward ends of said gripping arms.

26. The bow string release of claim 25 wherein said ball engaging surfaces include a pair of flats engaged by said ball actuator in said closed draw position, and a pair of curved ramping surfaces engaged by said ball actuator in said open release position.

27. The bow string release of claim 26 wherein said trigger includes a projection positioned to engage said actuator ball and to push said actuator ball away from said flats.

28. A bow string release device comprising:

a housing;

a pair of gripping arms pivotally secured within said housing for movement toward and away from each other, said gripping arms each including forward and rearward ends;

an actuator ball mounted in said housing for axial movement and interposed between said gripping arms;

a spring extending axially between said gripping arms, one of said spring engaging surfaces of said gripping arms and an opposite end of said spring engaging said actuator ball, said ball normally biased to a position between said rearward ends of said gripping arms to thereby hold said gripping arms in a closed draw position; and a trigger pivotally mounted in said housing and including a projection adapted to engage and move said actuator ball axially forwardly to thereby cause said gripping arms to move from said closed draw position to an open release position.

29. The release of claim 28 wherein each gripping ann has a corresponding gripping jaw.

30. The release of claim 29 wherein each gripping jaw includes a substantially semi-spherical socket.

31. The release of claim 28 wherein each gripping arm is formed with a pair of spaced apart gripping jaws.

32. The release of claim 31 wherein each gripping jaw includes a substantially semi-spherical socket.

* * * * *